US008166954B2

(12) United States Patent
Park

(10) Patent No.: US 8,166,954 B2
(45) Date of Patent: May 1, 2012

(54) LUBRICATION APPARATUS OF FUEL PUMP DRIVEN BY FUEL PUMP DRIVE CAM

(75) Inventor: Jae Suk Park, Gunpo (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 152 days.

(21) Appl. No.: 12/581,657

(22) Filed: Oct. 19, 2009

(65) Prior Publication Data

US 2010/0139610 A1 Jun. 10, 2010

(30) Foreign Application Priority Data

Dec. 5, 2008 (KR) ..... 10-2008-0123539

(51) Int. Cl.
*F02M 37/04* (2006.01)
*F01M 1/02* (2006.01)

(52) U.S. Cl. ..... 123/508; 123/196 R; 123/90.33

(58) Field of Classification Search ..... 123/508, 123/509, 196 R, 90.33–90.38
See application file for complete search history.

(56) References Cited

U.S. PATENT DOCUMENTS

| | | | | |
|---|---|---|---|---|
| 4,476,836 | A * | 10/1984 | Enomoto et al. | 123/502 |
| 4,538,561 | A * | 9/1985 | Amemori et al. | 123/90.44 |
| 5,398,658 | A * | 3/1995 | Mesimaki | 123/509 |
| 5,603,303 | A * | 2/1997 | Okajima et al. | 123/508 |
| 2010/0139610 | A1 * | 6/2010 | Park | 123/196 R |
| 2011/0126793 | A1 * | 6/2011 | Ahn | 123/196 R |
| 2011/0146626 | A1 * | 6/2011 | Maruyama et al. | 123/495 |

FOREIGN PATENT DOCUMENTS

JP 2008-286124 A 11/2008

* cited by examiner

*Primary Examiner* — Thomas Moulis
(74) *Attorney, Agent, or Firm* — Morgan, Lewis & Bockius LLP

(57) ABSTRACT

A lubrication apparatus of a fuel pump driven by a fuel pump drive cam, which lubricates a tappet moving reciprocally at an interior circumference of a fuel pump adaptor and the fuel pump operating the tappet, may include a fuel pump adaptor lubrication passage formed in the fuel pump adaptor and communicating with an oil gallery formed inside a cylinder head so as to supply oil in the fuel pump adaptor.

10 Claims, 2 Drawing Sheets

LUBRICATION APPARATUS OF FUEL PUMP DRIVEN BY FUEL PUMP DRIVE CAM

CROSS-REFERENCE TO RELATED APPLICATION

The present application claims priority to Korean Patent Application No. 10-2008-0123539 filed on Dec. 5, 2008, the entire contents of which are incorporated herein for all purposes by this reference.

BACKGROUND OF THE INVENTION

1. Field of the Invention

The present invention relates to a lubrication structure, and more particularly to a lubrication apparatus of a fuel pump driven by a fuel pump drive cam that is capable of effectively lubricating a tappet, a tappet roller, and a cam of an engine.

2. Description of Related Art

Technologies for a gasoline direct injection (GDI) engine have been studied in order to improve fuel consumption and performance of the engine.

The GDI engine technologies are methods in which only air is drawn into the combustion chamber and is compressed and then fuel is injected therein, while in the case of a conventional gasoline engine, power is generated in a period of an intake stroke, a compression stroke, an ignition stroke, and an exhaust stroke process of an air/fuel mixture.

Such a method is similar to a compressed ignition engine method.

Due to a high compression ratio of the GDI engine, a high compression ratio that is capable of exceeding a limit of a usual gasoline engine results in maximization of fuel consumption.

The GDI engine depends on a high fuel pressure, and a high performance fuel pump is required.

The fuel pump is mechanically driven by a cam so as to operate a tappet, and friction inside the fuel pump is generated.

A great deal of friction occurs in the fuel pump due to the high pressure of the fuel.

Therefore, a lubrication device of the fuel pump for compressing the fuel in the GDI engine has been studied in order to improve durability and performance of the GDI engine.

To solve the problems, as an example, a method of lubricating the cam with oil stored in a predetermined space when a camshaft for the fuel pump is rotated is used.

Such a method has a merit of simplifying the structure, but it is difficult to lubricate throughout the fuel pump, and it is difficult to lubricate it at a slanted surface.

Further, there is a method, as another example, which forms an oil hole at the cam so as to flow oil therein.

However, the method mentioned above has a drawback in that it is capable of lubricating only a specific part that is provided with an oil hole, and it is impossible to form a hole at a portion of the cam contacting the tappet of the fuel pump.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a lubrication apparatus of a fuel pump that is driven by a fuel pump drive cam having advantages of preventing abrasion and deterioration of a contacting portion between a tappet and a fuel pump adaptor, and between a fuel pump drive cam and a tappet roller, by directly supplying oil thereto through a fuel pump adaptor lubrication passage formed respectively facing the tappet roller and the fuel pump drive cam.

In an aspect of the present invention, the lubrication apparatus of a fuel pump driven by a fuel pump drive cam, which lubricates a tappet moving reciprocally at an interior circumference of a fuel pump adaptor and the fuel pump operating the tappet, may include a fuel pump adaptor lubrication passage formed in the fuel pump adaptor and communicating with an oil gallery formed inside a cylinder head so as to supply oil in the fuel pump adaptor.

The fuel pump adaptor lubrication passage may be divided into a tappet lubrication nozzle and a cam lubrication nozzle at an end thereof.

Diameters of the tappet lubrication nozzle and the cam lubrication nozzle may be less than approximately 1.2 mm respectively.

The tappet lubrication nozzle may supply the oil to the interior circumference of the fuel pump adaptor and a contact portion of a tappet roller and the fuel pump drive cam, wherein the tappet lubrication nozzle supplies the oil to the tappet.

The cam lubrication nozzle may supply the oil to a contact portion between a tappet roller and the fuel pump drive cam.

The cam lubrication nozzle may supply the oil to an exterior circumference of the fuel pump drive cam.

The tappet lubrication nozzle and the cam lubrication nozzle may be slanted upwardly and downwardly respectively in the fuel pump adaptor such that a predetermined included angle is formed therebetween.

The oil gallery may be applied to a fuel pump of a gasoline direct injection engine so as to supply the oil.

In another aspect of the present invention, the lubrication apparatus of a fuel pump driven by a fuel pump drive cam, which lubricates a tappet moving reciprocally at an interior circumference of a fuel pump adaptor and the fuel pump operating the tappet, may include a tappet lubrication nozzle supplying the oil to the interior circumference of the fuel pump adaptor and a contacting portion of the tappet, and a cam lubrication nozzle supplying the oil to a fuel pump drive cam.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
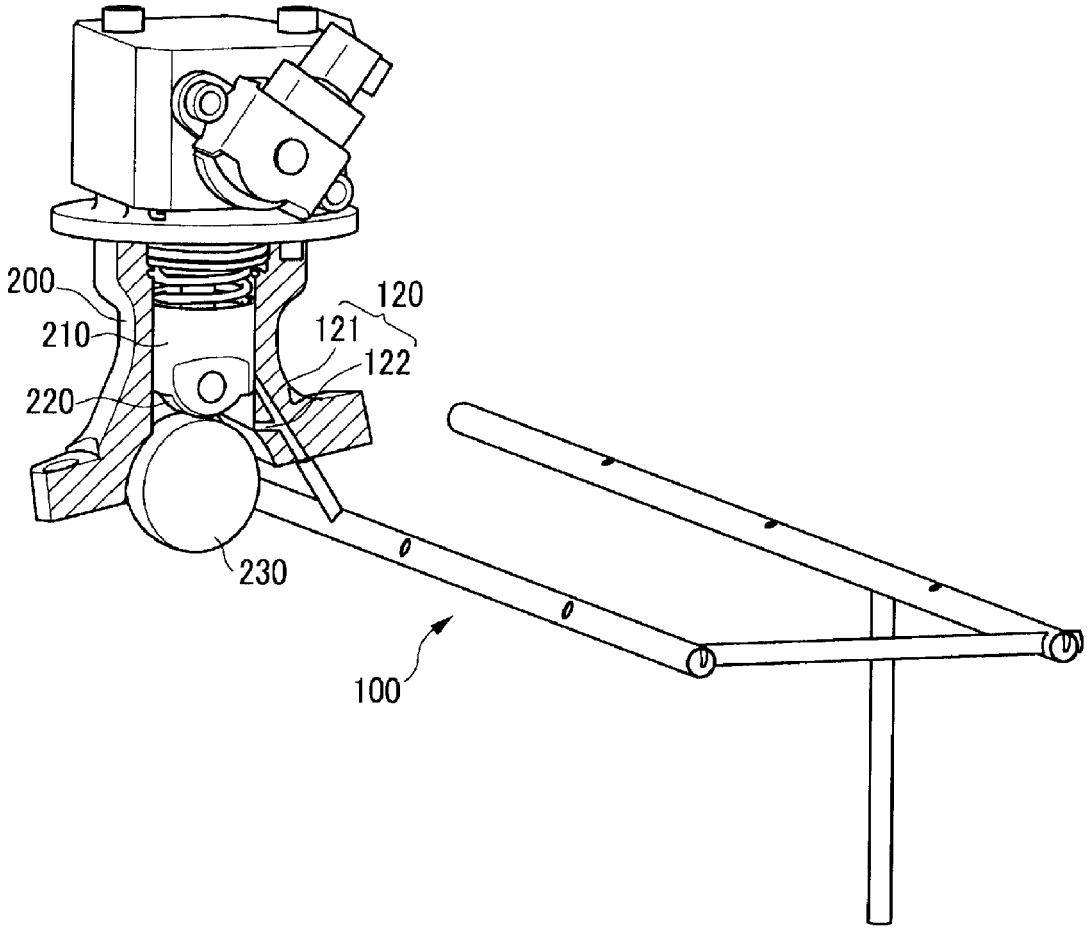
FIG. 1 is a perspective view of a main portion showing an exemplary lubrication device of a fuel pump driven by a fuel pump drive cam according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will be hereinafter described in detail with reference to the accompanying drawings.

Figure 2:
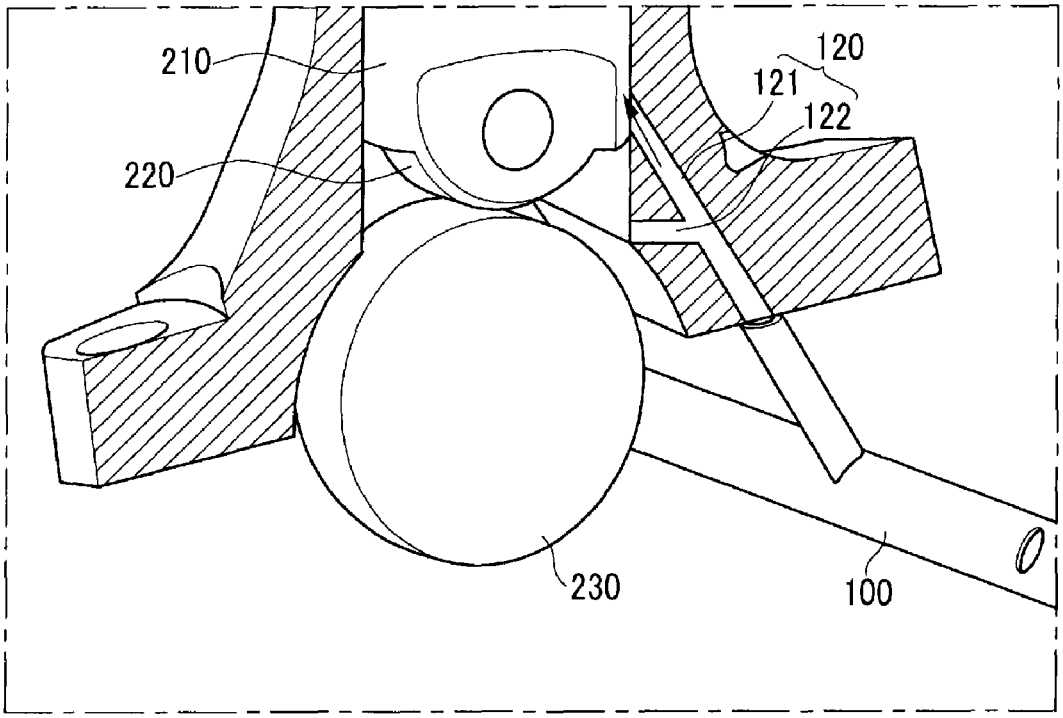
FIG. 2 is a cross-sectional perspective view of a main portion showing an exemplary lubrication device of a fuel pump driven by a fuel pump drive cam according to the present invention.

FIG. 1 is a perspective view of main portion showing a lubrication device of a fuel pump driven by a fuel pump drive cam, and FIG. 2 is a perspective view of main portion showing a lubrication device of a fuel pump driven by a fuel pump drive cam.

Referring to FIG. 1 and FIG. 2, a lubrication device of a fuel pump driven by a fuel pump drive cam according to an exemplary embodiment of the present invention includes an oil gallery 100 formed inside a cylinder head, and a fuel pump adaptor lubrication passage 120 communicated with the oil gallery 100.

The fuel pump adaptor lubrication passage 120 is divided into a tappet lubrication nozzle 121 and a cam lubrication nozzle 122 at the end thereof, so as to lubricate the interior of the fuel pump adaptor 200.

In this case, the diameter of the tappet lubrication nozzle 121 and the cam lubrication nozzle 122 should respectively be less than 1.2 mm so as to guarantee sufficient pressure that is capable of precisely lubricating a portion that is subjected to a great amount of friction.

That is, oil injected from an oil pump passes through the oil gallery 100, and then it is supplied to the fuel pump adaptor lubrication passage 120 in order to lubricate and cool the interior of the fuel pump adaptor 200.

The tappet lubrication nozzle 121 and the cam lubrication nozzle 122 may be formed to be slanted upwardly so as to supply the oil to the interior of the fuel pump adaptor 200.

At this time, the tappet lubrication nozzle 121 and the cam lubrication nozzle 122 may be branched from an end of the fuel pump adaptor lubrication passage 120.

That is, the tappet lubrication nozzle 121 is formed such that it supplies the oil to a tappet 210 mounted inside a fuel pump adaptor 200, and to a portion between a tappet roller 220 disposed at the bottom of the tappet 210 and a fuel pump drive cam 230 rotating frictionally therewith.

At the same time, an end portion of the tappet lubrication nozzle 121 is formed such that it is slanted from the lower side to the upper side, so a lateral portion of the tappet is lubricated.

Therefore, the oil injected from the tappet lubrication nozzle lubricates the portion between the tappet roller 220 and the fuel pump drive cam 230 with its own weight.

Meanwhile, the cam lubrication nozzle 122 is formed such that it can supply the oil to a contacting portion between the cam 230 and the roller 220.

The cam lubrication nozzle 122 may preferably be formed so that it is slanted downwardly toward the cam 230, and thereby the oil is supplied to an exterior circumference of the roller 220 by the cam lubrication nozzle 122 so as to form a lubricant film thereon.

As a result, friction generated between the tappet 210 and the tappet roller 220 is reduced, so abrasion of the lower surface of the tappet 210 is prevented.

Therefore, a fuel pump lubrication apparatus driven by a cam according to an exemplary embodiment of the present invention reduces friction and also reduces abrasion or noise generated by the friction by simultaneously lubricating contact portions between the tappet 210 and the tappet roller 220, and the tappet roller 220 and the fuel pump drive cam 230.

For convenience in explanation and accurate definition in the appended claims, the terms "upper," "lower," and "interior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lubrication apparatus of a fuel pump driven by a fuel pump drive cam, which lubricates a tappet moving reciprocally at an interior circumference of a fuel pump adaptor and the fuel pump operating the tappet, the apparatus comprising a fuel pump adaptor lubrication passage formed in the fuel pump adaptor and communicating with an oil gallery formed inside a cylinder head so as to supply oil in the fuel pump adaptor.

2. The apparatus of claim 1, wherein the fuel pump adaptor lubrication passage is divided into a tappet lubrication nozzle and a cam lubrication nozzle at an end thereof.

3. The apparatus of claim 2, wherein diameters of the tappet lubrication nozzle and the cam lubrication nozzle are less than approximately 1.2 mm respectively.

4. The apparatus of claim 2, wherein the tappet lubrication nozzle supplies the oil to the interior circumference of the fuel pump adaptor and a contact portion of a tappet roller and the fuel pump drive cam.

5. The apparatus of claim 4, wherein the tappet lubrication nozzle supplies the oil to the tappet.

6. The apparatus of claim 2, wherein the cam lubrication nozzle supplies the oil to a contact portion between a tappet roller and the fuel pump drive cam.

7. The apparatus of claim 2, wherein the cam lubrication nozzle supplies the oil to an exterior circumference of the fuel pump drive cam.

8. The apparatus of claim 2, wherein the tappet lubrication nozzle and the cam lubrication nozzle are slanted upwardly and downwardly respectively in the fuel pump adaptor such that a predetermined included angle is formed therebetween.

9. The apparatus of claim 1, wherein the oil gallery is applied to a fuel pump of a gasoline direct injection engine so as to supply the oil.

10. A lubrication apparatus of a fuel pump driven by a fuel pump drive cam, which lubricates a tappet moving reciprocally at an interior circumference of a fuel pump adaptor and the fuel pump operating the tappet, the apparatus comprising a tappet lubrication nozzle supplying the oil to the interior circumference of the fuel pump adaptor and a contacting portion of the tappet; and a cam lubrication nozzle supplying the oil to a fuel pump drive cam.

* * * * *